US008012272B2

(12) United States Patent
Shimizu

(10) Patent No.: US 8,012,272 B2
(45) Date of Patent: Sep. 6, 2011

(54) TOOL STEELS AND MANUFACTURING METHOD THEREOF

(75) Inventor: Takayuki Shimizu, Nagoya (JP)

(73) Assignee: Daido Tokushuko Kabushiki Kaisha, Nagoya, Aichi (JP)

( * ) Notice: Subject to any disclaimer, the term of this patent is extended or adjusted under 35 U.S.C. 154(b) by 415 days.

(21) Appl. No.: 12/289,539

(22) Filed: Oct. 30, 2008

(65) Prior Publication Data

US 2009/0107587 A1 Apr. 30, 2009

(30) Foreign Application Priority Data

Oct. 31, 2007 (JP) ..... 2007-284326
Aug. 11, 2008 (JP) ..... 2008-206810

(51) Int. Cl.
*C22C 38/46* (2006.01)
*C22C 38/44* (2006.01)
*C22C 38/60* (2006.01)
*C21D 8/00* (2006.01)

(52) U.S. Cl. ..... 148/335; 148/334; 148/325; 148/326; 148/328; 148/649; 148/653; 148/654; 420/108; 420/109; 420/84; 420/87

(58) Field of Classification Search ..... 420/108.109, 420/111, 69, 61, 108, 109, 41, 42, 84, 87; 148/334, 335, 325, 326, 328, 649, 653, 654
See application file for complete search history.

(56) References Cited

FOREIGN PATENT DOCUMENTS

| | | |
|---|---|---|
| EP | 0869196 | 10/1998 |
| EP | 1072691 | 1/2001 |
| JP | 2000-212699 | 8/2000 |
| JP | 2003-055743 | 8/2001 |
| JP | 2001-294974 | 10/2001 |
| JP | 2001-316769 | 11/2001 |
| JP | 2004-346346 | 5/2003 |
| JP | 2003-226939 | 8/2003 |
| JP | 2005-113161 | 4/2005 |
| JP | 2005-226150 | 8/2005 |
| JP | 2006-328521 | 12/2006 |

OTHER PUBLICATIONS

Shimizu, Takayuki et al, "Influence of Coarse Carbide Volume on Anisotrophy of Dimensional Change at Heat Treatment of Cold Work Die Steels", *Denki Seiko* 78(4), pp. 289-298 (2007), with abstract from *Chemical Abstracts*.

Shimizu, Takayuki et al, "Influence of Carbon and Chromium Contents on Heat Treatment Distortion of Cold Work Die Steels", *Kata Gijutsu* 22(14), pp. 50-51 (2007), with abstract from *Chemical Abstracts*.

*Primary Examiner* — Deborah Yee
(74) *Attorney, Agent, or Firm* — Bacon & Thomas, PLLC

(57) ABSTRACT

The present invention provides a tool steel containing, by mass percent, 0.55 to 0.85% of C, 0.20 to 2.50% of Si, 0.30 to 1.20% of Mn, 0.50% or less of Cu, 0.01 to 0.50% of Ni, 6.00 to 9.00% of Cr, 0.1 to 2.00% of Mo+0.5 W, and 0.01 to 0.40% of V, with the balance of Fe and inevitable impurities, in which, when an area rate of a coarse carbide having a circle equivalent diameter of 2 μm or more in a cross section parallel to a forging direction is represented by L(%) and an area rate of the coarse carbide in a cross section perpendicular to the forging direction is represented by T(%), the area rate L is 0.001% or more, the area rate T is 0.001% or more, and the ratio L/T is within a range from 0.90 to 3.00. The tool steel of the invention exhibits an isotropic size change in quenching and tempering.

14 Claims, 1 Drawing Sheet

TOOL STEELS AND MANUFACTURING METHOD THEREOF

FIELD OF THE INVENTION

The present invention relates to tool steels, and more particularly to tool steels which expand isotropically at the time of quenching and tempering, and a manufacturing method thereof.

BACKGROUND OF THE INVENTION

Conventionally, tool steels have been widely used for forming a mold (such as trimming, die, or drawing) for cold forging, precision forging, progressive press, plastic molding, warm forging, powder molding and magnet molding, and mold parts attached to the mold.

Tool steels are materials which are required to have high hardness and hence, the structure of the tool steels is transformed into martensite by applying quenching and tempering to them so as to impart desired hardness, and such tool steels are used as materials of the above-mentioned mold or the like.

Tool steels expand a volume thereof due to quenching and tempering. Although there arises no problem when the expansion is an isotropic expansion, conventional cold work tool steels generate anisotropic and non-uniform expansion thus giving rise to a serious problem in the manufacture of a mold or the like.

This anisotropic and non-uniform expansion of tool steels is liable to conspicuously appear particularly with respect to tool steels containing a large quantity of carbide. However, the reason of such a phenomenon has not been clarified yet.

The anisotropic and non-uniform expansion of tool steels gives rise to a following problem in the manufacture of a mold, for example.

In the manufacture of a mold, a tool steel is roughly formed into a rough mold having a shape and a size which are preliminarily estimated by adding a size change to be caused by heat treatment to a desired mold size and, thereafter, quenching and tempering are applied to the rough mold and, finally, finish working is applied thereto to form a mold having a desired shape.

In the case that the mold material (tool steel) generates an isotropic expansion thereof due to quenching and tempering, the mold may be roughly formed into a size and a shape allowing the expansion of equal quantity in all directions.

However, when the mold material extends (expands) largely in one direction while extends little or contracts in another direction due to quenching and tempering, it is necessary to determine the size of the mold material before quenching and tempering with taking a size change in such another direction into consideration.

However, the direction that the mold material extends due to quenching and tempering also differs depending on the direction along which a material to be the mold is taken out from a raw material. Therefore, there is no reproducibility of size after quenching and tempering and the size of the mold cannot be controlled with desired accuracy. This drawback largely hampers the manufacture of the mold.

Accordingly, for example, compared with mold size accuracy of ±0.03% (size accuracy of ±30 μm when a length of the mold is 100 mm) which is required to be satisfied by general users, a size of the mold before heat treatment is conventionally made uniformly large (approximately +0.06%) so that even when the size cannot be controlled due to quenching and tempering (+0.06±0.03%=0.03% to 0.09%), a sufficient machining margin (+0.03% or more, and 1 to 30 μm being removed when the machining margin by cutting is less than 0.03%, and this cutting being difficult from a viewpoint of rigidity of a machine or the like) is ensured.

However, in this case, a machining margin of finish working becomes 0.09% at maximum and, at the same time, tool steel is basically a material which has high hardness and hence, working after heat treatment requires a considerably long time (assuming that cutting is performed for every 0.03%, it is necessary to perform cutting three times).

Alternatively, there also arises a serious drawback that a load which a cutting tool receives is excessively increased (when the working margin of 0.09% being worked one time), leading to breaking of the cutting tool.

Accordingly, there has been a strong demand for the reduction of machining margin. However, factors which controls the non-uniformity of expansion due to heat treatment has not been revealed and hence, no countermeasure has been found up to now.

JP-A-2005-113161 discloses a technique which aims at solving a problem on anisotropy of thermal expansion ratio in hot work tool steels. In this case, the thermal expansion ratio is a ratio at which the material to which heat treatment of quenching and tempering is applied (with no phase transformation) expands corresponding to a temperature.

The present invention relates to a heat treatment in quenching and tempering, that is, the isotropy of a size change of a tool steel when the phase transformation is generated. Therefore, the present invention fundamentally differs from the technique disclosed in JP-A-2005-113161 with respect to a point that the phase transformation is present or not. Accordingly, the isotropy of the size change of the tool steel of the present invention when the phase transformation is generated should not be estimated by this document.

Further, JP-A-2003-226939 discloses a technique which improves machinability by controlling particle sizes and quantities of carbide and non-metallic inclusions in hot work tool steel.

However, this document fails to disclose the problems to be solved by the present invention, and the present invention also differs from the technique disclosed in this document with respect to a technique for overcoming the problems.

SUMMARY OF THE INVENTION

The present invention has been made under the above-mentioned circumstances, and an object of the present invention is to provide a tool steel exhibiting an isotropic size change accompanied by a phase transformation due to quenching and tempering while satisfying use hardness of 55HRC or more as a tool steel, and a manufacturing method thereof.

Namely, the present invention relates to the following items 1 to 7.

1. A tool steel comprising, by mass percent,
0.55 to 0.85% of C,
0.20 to 2.50% of Si,
0.30 to 1.20% of Mn,
0.50% or less of Cu,
0.01 to 0.50% of Ni,
6.00 to 9.00% of Cr,
0.1 to 2.00% of Mo+0.5W, and
0.01 to 0.40% of V,
with the balance of Fe and inevitable impurities,
wherein when an area rate of a coarse carbide having a circle equivalent diameter of 2 μm or more in a cross section parallel to a forging direction is represented by L(%) and an area rate of the coarse carbide in a cross section perpendicular to the forging direction is represented by T(%), the area rate L is 0.001% or more, the area rate T is 0.001% or more, and the ratio L/T is within a range from 0.90 to 3.00.

2. The tool steel according to item 1, wherein the area rate L is 0.5% or less, and the area rate T is 0.5% or less.

3. The tool steel according to item 1 or 2, which further comprises, by mass percent, at least one element selected from the group consisting of:

0.040 to 0.100% of S, 0.040 to 0.100% of Se, and 0.040 to 0.100% of Te.

4. The tool steel according to item 3, which further comprises, by mass percent, 0.0001 to 0.0150% of Ca.

5. The tool steel according to any one of items 1 to 4, wherein contents of Al, O, and N are regulated to 0.50% or less, 0.0050% or less, and 0.0200% or less, respectively.

6. The tool steel according to any one of items 1 to 5, which further comprises, by mass percent, at least one element selected from the group consisting of:

0.01 to 0.15% of Nb, 0.01 to 0.15% of Ta, 0.01 to 0.15% of Ti, and 0.01 to 0.15% of Zr.

7. A manufacturing method of a tool steel, comprising performing a hot forging at a forging ratio within a range from 0.85 to 30, whereby when an area rate of a coarse carbide having a circle equivalent diameter of 2 μm or more in a cross section parallel to a forging direction is represented by L(%) and an area rate of the coarse carbide in a cross section perpendicular to the forging direction is represented by T(%), the area rate L is set to 0.001% or more, the area rate T is set to 0.001% or more, and the ratio L/T is set within a range from 0.90 to 3.00.

As described above, according to the present invention, the tool steel has the above-mentioned composition, in which, when an area rate of a coarse carbide having a circle equivalent diameter of 2 μm or more in a cross section parallel to a forging direction is represented by L(%) and an area rate of the coarse carbide in a cross section perpendicular to the forging direction is represented by T(%), the area rate L is 0.001% or more, the area rate T is 0.001% or more, and the ratio L/T is within a range from 0.90 to 3.00. Owing to such a constitution, the expansion of the tool steel when the tool steel is subjected to quenching and tempering can be turned into an isotropic expansion.

Incidentally, in the present specification, forging is a concept which includes rolling.

BEST MODE FOR CARRYING OUT THE INVENTION

Figure 1A:
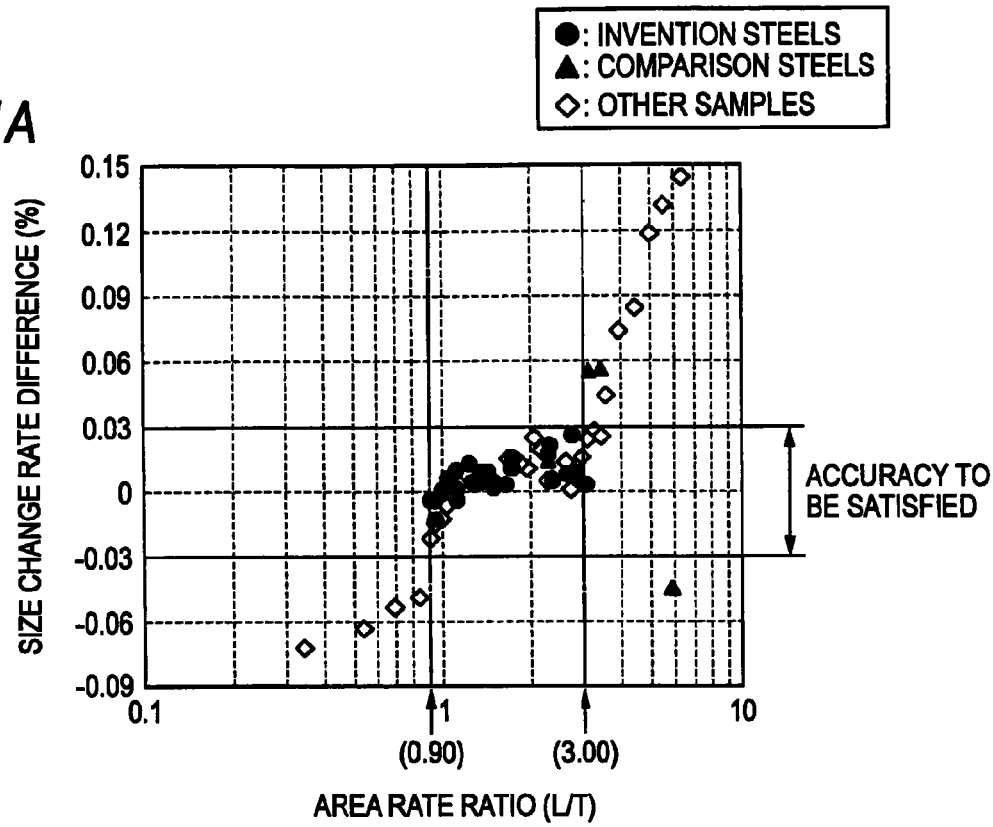
FIG. 1A is a view showing the relationship between an area rate ratio (L/T) and a size change rate difference.

The inventor of the present invention, in the course of study for solving a phenomenon in which a tool steel is anisotropically and non-uniformly expanded due to quenching and tempering, has focused on a distribution state of carbides, has investigated the relationship between the distribution state of the carbides and the expansion of the tool steel, and has made a finding that the close relationship is present between the distribution state of the carbides and the expansion of the tool steel.

To be more specific, based on the fact that the expansion of tool steel after quenching and tempering is large in the forging direction and is small in the direction perpendicular to the forging direction, the inventor investigated the distribution state of carbides in a cross section parallel to the forging direction and the distribution state of the carbides in a cross section perpendicular to the forging direction. As a result of the investigation, the inventor has found that, in the cross section parallel to the forging direction, coarse carbides having a circle equivalent diameter of 2 μm or more form aggregates and the aggregates are distributed in a state that the aggregates are elongated in the forging direction, and an area rate of the carbides is also large; while in the cross section perpendicular to the forging direction, different from the above-mentioned state, carbides are relatively uniformly distributed in a non-aggregated state and the area rate of carbides is also small.

Further, when the inventor of the present invention has investigated the relationship between the distribution state of the carbides and the expansion of the tool steel due to quenching and tempering, the magnitude of the expansion is correlated with the area rate of the carbides, in which the larger the area rate is, the larger the magnitude of the expansion becomes.

Although a cause of the phenomenon that the expansion due to quenching and tempering is increased along with the increase of area rate of the coarse carbides and the expansion of the tool steel is decreased along with the decrease of area rate of the carbides has not been clarified yet, the following reason may be estimated.

When a strength of carbides and a strength of a base material around the carbides, that is, a metal matrix are compared, in all ranges from a room temperature to a quenching temperature, carbides exhibit an extremely high strength compared with the base material. Accordingly, due to a thermal stress generated by heat treatment, particularly due to a transformation stress generated by austenite transformation at the time of heating or martensite transformation at the time of cooling, the base material, that is, the metal matrix is distorted to thereby generate a stress relaxation.

When the area rate of carbides differs between the forging direction of the tool steel and the direction perpendicular to the forging direction, it is considered that the distortion of the base material, that is, the metal matrix, also differs depending on the direction, and this phenomenon is considered to be a cause of the anisotropic expansion of the tool steel.

Accordingly, to make the expansion of the tool steel due to quenching and tempering in the forging direction and the expansion of the tool steel due to quenching and tempering in the direction perpendicular to the forging direction uniform, that is, to realize the isotropic expansion of the tool steel, the distribution of coarse carbides may be made uniform in the forging direction as well as in the direction perpendicular to the forging direction.

In fact, when the inventor of the present invention has carried out a test for confirming such an idea, the inventor has found that, along with the decrease of a ratio between the area rate L of a coarse carbide in a cross section parallel to the forging direction and the area rate T of the coarse carbide in a cross section perpendicular to the forging direction, the expansion of the tool steel due to quenching and tempering becomes more isotropic.

Although an ideal value of the area rate ratio L/T is 1, in the manufacture of a mold or the like, provided that the area rate ratio L/T is set to a value which falls within a range from 0.9 to 3.00, the tool steel can acquire sufficiently uniform size change (due to quenching and tempering).

The present invention has been made based on such findings.

Herein, the sufficiently uniform size change implies that the difference between a size change rate (%) in the forging direction and a size change rate (%) in the direction perpendicular to the forging direction falls within a range from −0.03 to 0.03.

When the difference does not fall within such a range, such a tool steel cannot satisfy mold size accuracy of ±0.03%, which is required in general (this is because even when the size accuracy is satisfied in the forging direction, the size accuracy in the direction perpendicular to the forging direction is not satisfied).

As a method of realizing the above-mentioned distribution of carbides, the manufacturing method including the following steps (1) and (2) is preferably applicable.

Step (1): A step of casting a steel material under a condition that a cooling rate from starting of the casting to completion of solidification (1200° C.) is set to a value which falls within a range from 0.1 to 5.0° C./min. In this step, the cast material may be re-melted (secondary melting), followed by re-solidifying the molten cast material (in general, secondary melting and casting technique by VAR (vacuum arc remelting) or ESR (electro slag remelting)). Further, a powder material may be used and a tool steel may be produced by HIP (hot isostatic pressing).

Step (2): A step which includes performing soaking treatment at least once at a temperature of 1100 to 1250° C. for 10 hours or more, and starting hot forging (including rolling) within a temperature range of 900 to 1250° C. such that a forging ratio of 0.85 to 30 is acquired.

The step (1) is a step in which the coarse carbides generated by casting are made fine. The higher the cooling rate from starting of casting to completion of solidification is, the smaller the size of the formed coarse carbides becomes. To control the size, quantity and a distribution state of the coarse carbides in proper ranges by the soaking treatment in the step (2), it is necessary to set the cooling rate at the time of casting to 0.1° C./min or more. However, in an actual operation, rapid cooling with the cooling rate exceeding 5.0° C./min is difficult in view of a casting quantity or the like and hence, casting may be performed within the above-mentioned range.

Further, in the application of the secondary melting, since melting and solidification are performed in a short time, such melting and solidification in a short time corresponds to speeding up of the cooling rate. When a powder material is used, carbides in the cast material have a fine particle size as compared with carbides in a usual cast material. However, a manufacturing cost is expensive and hence, this has a drawback in practical use in terms of the cost.

The step (2) is an optimum step for controlling coarse carbides within a proper range. It is necessary to perform a soaking treatment at a temperature higher than a quenching temperature and lower than a melting point. By properly performing the soaking treatment, provided that the cast material is manufactured by the step (1), it is possible to make the size of the formed coarse carbides smaller, to reduce a quantity of the carbides, and to uniformly disperse the carbides. Proper values of soaking temperature and time differ depending on components.

The proper value of temperature is obtained by heating the cast material manufactured by the step (1) to a value which falls within a range of −50 to −10° C. from a melting point (also implying a temperature at which a component segregated portion locally melts). When the cast material is partially melted by soaking, cracks occur in the cast material. To the contrary, when the temperature is lower than the proper value, the dissolution of coarse carbides becomes insufficient and hence, it is impossible to control the distribution of the carbides within a proper range.

Although the proper time for soaking differs depending on the soaking temperature, the proper time may preferably be 10 hours or more with taking the manufacture of the cast material in a plant into consideration.

The forging temperature is equal to or below the soaking temperature. Provided that the forging temperature is equal to or above 900° C. at which hot forging can be performed, forging may be performed by selecting any temperature.

However, when carbides which are dissolved into a solid-solution state by soaking is re-precipitated at a low forging temperature, the distribution of carbides which falls within a range of the present invention cannot be obtained. Accordingly, it is desirable to start forging at a temperature close to soaking temperature as much as possible (temperature within 50° C. with respect to soaking temperature).

The forging ratio is a value which is defined by (cross-sectional area before forging)/(cross-sectional area after forging) and, in general, the larger the forging ratio is, the more carbides are elongated in the forging direction.

By applying the manufacturing method including steps (1) and (2), the basically coarse carbides can be dissolved into a solid-solution state and can be controlled and hence, the correlation is not always necessarily found between the magnitude of the forging ratio and the area rate ratio (L/T) of the distribution state of the carbides.

However, when the forging ratio is increased extremely, the structure of a base material, that is, a metal matrix acquires a strong orientation state (crystal azimuths being not arranged in the random directions but in the peculiar direction) and hence, anisotropy of size change attributed to heat treatment is generated due to such heat treatment.

Since the isotropy is mandatory in the present invention, it is necessary to suppress the forging ratio to a value of 30 or less. On the other hand, the forging ratio of being less than 1 implies that the cross sectional area after forging is increased than the cross sectional area of the cast material and hence, in general, the forging is realized by so-called upset forging. In an upset state, in general, coarse carbides at the time of casting remain in a large quantity and hence, the alloy cannot be used in this state. However, by adopting the manufacturing method including steps (1) and (2), it is possible to ensure the anisotropy of size change due to heat treatment even in an upset state.

The application of the manufacturing method including steps (1) and (2) is particularly effective in acquiring advantageous effects of the present invention.

Further, when the area rates L and T are respectively set to 0.5% or less in accordance with item 2 above, the size change rate difference (difference in size change rate) can satisfy the extremely high mold size accuracy of ±0.01%.

As described above, it is ideal to set the ratio between the area rate L of carbides in a cross section parallel to the forging direction and the area rate T of the carbides in a cross section perpendicular to the forging direction to 1/1.

When the area rates L and T are respectively set to 0.5% or less in accordance with item 2 above, the area rate of carbides in the cross section parallel to the forging direction and the area rate of the carbides in the cross section perpendicular to the forging direction respectively assume small values. That is, the distribution of the carbides per se becomes extremely small and hence, aggregates of carbides can be hardly formed basically. Accordingly, non-uniformity in carbide distribution attributed to the elongation of the aggregates of the carbides per se in the forging direction is hardly generated and hence, the distribution of the carbides in the forging direction and the distribution of the carbides in the direction perpendicular to the forging direction become substantially equal to each other.

That is, as a means to approximate the ratio between the area rates L and T to 1/1, the method described in item 2 above is an effective means.

Further, at least one element selected from the group consisting of S, Se and Te can be added as a selective element in accordance with item 3 above. Herein, Ca may be added together with S, Se or Te in accordance with item 4 above. Further, an addition quantity of Al, O or N may be restricted in accordance with item 5 above. Further, at least one element selected from the group consisting of Nb, Ta, Ti and Zr may be further added in accordance with item 6 above.

Next, in accordance with item 7 above, the tool steel is manufactured such that hot forging is performed at a forging ratio within a range from 0.85 to 30, whereby a ratio L/T between an area rate L of coarse carbides in a cross section parallel to the forging direction and an area rate T of coarse carbides in a cross section perpendicular to the forging direction is set to a value which falls within a range from 0.90 to 3.00. Due to such a manufacturing method, a tool steel which exhibits uniform expansion by quenching and tempering in the forging direction as well as in the direction perpendicular to the forging direction can be favorably manufactured.

Next, the reasons for limiting chemical component or the like in the present invention are explained hereinafter in detail. In this regard, unless otherwise indicated, all the percentages in the followings indicate those defined by mass, which are the same as those defined by weight, respectively.

"Both of an area rate L of a coarse carbide having diameter of 2 μm or more in a cross section parallel to the forging direction and an area rate T of the coarse carbide in a cross section perpendicular to the forging direction are respectively set to a value of 0.001% or more and the ratio L/T is set to a value which falls within a range from 0.90 to 3.00".

By making the expansion in the forging direction and the expansion in the direction perpendicular to the forging direction become the substantially isotropic expansion so as to satisfy the size tolerance necessary in both directions, it is desirable that the size change rate difference (difference in size change rate) is set to a value which falls within a range from −0.03 to 0.03.

To satisfy such size change rate difference, it is necessary to set the ratio L/T to a value which falls within a range from 0.90 to 3.00.

Fine carbide is dissolved into a solid-solution state or is precipitated due to quenching and tempering and hence, the influence of the fine carbide on the size change rate is hardly recognized.

Accordingly, it is necessary to treat the coarse carbide having a circle equivalent diameter of 2 μm or more, which hardly generates a solid-solution state or precipitation in the heat treatment, as an object (carbide).

Herein, the circle equivalent diameter is an equivalent diameter which is acquired by firstly obtaining an area of carbide to be observed and by converting the area into a circular area.

C: 0.55 to 0.85%

C is an element necessary for acquiring use hardness of 55HRC or more as a tool steel. A quantity of C is properly adjusted corresponding to required hardness. When the tool steel does not contain 0.55% or more of C, hardness of 55HRC or more cannot be acquired. On the other hand, even when C is added in an amount exceeding 0.85%, the contribution toward the increase of carbide or the increase of hardness are saturated.

The preferable range of the content of C is from 0.60 to 0.70%.

Si: 0.20 to 2.50%

Si is an element added as a deoxidizing element. In the actual manufacture, the reduction of amount of Si to a value below 0.20% pushes up a cost. On the other hand, when Si is added in an amount exceeding 2.50%, a state of carbide is changed from a granular shape to a rod shape and hence, the coarse carbide is liable to easily remain, whereby it is necessary to suppress an addition amount of Si to a value equal to or below an upper limit.

The preferable range of the amount of Si is from 0.90 to 2.20%.

Mn: 0.30 to 1.20%

To apply a tool steel to a large mold, part or the like, high hardenability is necessary. From a viewpoint of hardenability, quenching cannot be performed by air cooling when the addition of 0.30% or more of Mn is not ensured. On the other hand, when Mn is added in an amount exceeding 1.20%, it is possible to acquire sufficient hardenability. However, a retained austenite quantity is increased and hence, hardness is largely lowered. Accordingly, it is necessary to suppress an addition amount of Mn to a value equal to or less than an upper limit.

The preferable range of the amount of Mn is from 0.70 to 1.20%.

Cu≦0.50%

Cu is an inevitable element contained in a steel. When a content of Cu exceeds 0.50%, red shortness occurs during forging and hence, a tool steel cannot be manufactured. Accordingly, it is necessary to suppress an addition amount of Cu to 0.50% or less.

However, in the actual manufacture of a tool steel, the reduction of Cu content to a value less than 0.01% largely pushes up a cost and hence, 0.01% or more of Cu is considered rendered allowable.

Ni: 0.01 to 0.50%

To apply a tool steel to a large mold, part or the like, high hardenability is necessary. From a viewpoint of hardenability, quenching cannot be performed by air cooling when the addition of 0.01% or more of Ni is not ensured. On the other hand, when Ni is added in an amount exceeding 0.50%, it is possible to acquire sufficient hardenability. However, a retained austenite quantity is increased and hence, hardness is largely lowered. Accordingly, it is necessary to suppress the addition amount of Ni to a value equal to or less than an upper limit.

Cr: 6.00 to 9.00%

Cr binds with carbon to form a carbide and hence, Cr is a mandatory element for acquiring high quenching and tempering hardness. It is necessary to add 6.00% or more of Cr to form a carbide sufficient to contribute to hardness. On the other hand, even when Cr is added exceeding 9.00%, a carbide which does not contribute to hardness is formed in a large amount and hence, it is necessary to suppress the addition amount of Cr to a value equal to or less than an upper limit. The preferable range of the amount of Cr is from 6.50 to 8.00%.

Mo+0.5W: 0.1 to 2.00%

Mo and W bind with carbon to form a carbide and hence, Mo and W are mandatory elements for acquiring high quenching and tempering hardness. It is necessary to add 0.1% or more of Mo+0.5W to form a carbide sufficient to contribute to hardness. On the other hand, even when Mo+0.5W are added in an amount exceeding 2.00%, an excessively large amount of a carbide is contained in the tool steel and hence, toughness of the tool steel is remarkably deteriorated, whereby it is necessary to suppress the addition amount of Mo+0.5W to a value equal to or less than an upper limit.

V: 0.01 to 0.40%

V binds with carbon to form a carbide and hence, V is a mandatory element for acquiring high quenching and tempering hardness. It is necessary to add 0.01% or more of V to form a carbide sufficient to contribute to hardness. On the other hand, even when V is added exceeding 0.40%, an extremely coarse carbide is formed and hence, toughness of the tool steel is remarkably deteriorated, whereby it is necessary to suppress the addition amount of V to a value equal to or less than an upper limit.

The preferable range of V is from 0.03 to 0.20%.

At least one element selected from the group consisting of: 0.040 to 0.100% of S, 0.040 to 0.100% of Se, and 0.040 to 0.100% of Te Any one of these elements S, Se and Te can obtain the same effect and hence, any element may be selected (at least one element). Any one of these elements bind with Mn in the material thereby forming MnS, MnSe, MnTe or the like.

Due to the presence of MnS, MnSe or MnTe, it is possible to obtain advantageous effects such as drill machinability. That is, a tool wear quantity due to cutting can be reduced or a cutting speed can be enhanced compared with a conventional cutting speed. With respect to the addition of S or the like, due to the use of Mn in the material, when a large amount of S or the like exceeding 0.100% is added to a tool material, Mn quantity in the matrix is lowered. On the other hand, it is necessary to add 0.040% or more of S or the like to acquire a free cutting effect. Since Sn or the like does not contribute to the quantity, the size and the distribution of carbides at all, S or the like can be freely added to the tool material.

Ca: 0.0001 to 0.0150%

When Ca is simultaneously added with S, Ca is present in MnS as a Ca oxide or a dissolved Ca. In this case, it is known that the free cutting effect can be increased compared with a single use of MnS. To acquire the free cutting effect, the positive addition of 0.0001% or more of Ca is necessary. However, even when Ca is added in an amount exceeding 0.0150%, the free cutting effect becomes saturated and hence, the addition quantity of Ca is limited to an upper limit or less. In the same manner as S, since Ca does not contribute to the quantity, the size and the distribution of carbides at all, Ca can be freely added.

Al: ≦0.50%

O: ≦0.0050%

N: ≦0.0200%

These elements are contained in steel as inevitable impurities. However, when the amounts of these elements exceed respective upper limits thereof, a large amount of Al oxide or Al nitride is formed. When such a large amount of oxide or nitride is formed, this corresponds to the retention of a large amount of a coarse carbide and hence, from a viewpoint of isotropy of size change, it is desirable to reduce amounts of these elements as much as possible. However, the reduction of the amounts of these elements requires a long refining time or the like leading to the increase of a manufacturing cost and hence, there is no problem provided that the addition amounts of these elements are respectively restricted to values equal to or below the upper limits thereof.

At least one element selected from the group consisting of: 0.01 to 0.015% of Nb, 0.01 to 0.015% of Ta, 0.01 to 0.015% of Ti, and 0.01 to 0.015% of Zr These elements form an oxide, a nitride or a carbide. With the positive addition of these elements, non-metallic inclusions are formed so as to suppress coarsening of grains at the time of quenching thus enhancing toughness of the tool steel. Although coarse carbides is uniformly distributed in the steel of the present invention, these elements are added when a quantity of carbide is decreased so that the grains at the time of quenching become coarse.

The tool steel according to the present invention is mainly used for forming a mold. Among tool steels, cold work tool steel and high speed tool steel contain a large quantity of coarse amorphous carbides and hence, the tool steel according to the present invention is preferably used as such tool steels. Among these tool steels, anisotropic size change behavior is liable to be conspicuously recognized in the cold work tool steel and hence, the tool steel according to the present invention is preferably used as the cold work tool steel.

EXAMPLES

Next, an embodiment of the present invention is explained in more details hereinafter.

30 Kg of a steel material having the component composition shown in Table 1 was melted in a high frequency vacuum melting furnace and, thereafter, an ingot was formed. A cooling speed in this casting was 1.2° C./min. In this regard, comparison steel 2 is manufactured by performing a heating control with a heater and by setting a cooling rate in casting to 0.01° C./min. Then, a steel ingot was held at a plastic forming temperature (forging heating temperature) shown in Table 2 for 10 hours or more and, thereafter, hot forging was performed using a 500t-hammer-type forging machine thus manufacturing cold work tool steel.

Herein, forging was performed at a forging ratio shown in Table 1. The forging ratio is a ratio between the cross-sectional area before forging and the cross-sectional area after forging (cross-sectional area before forging/cross-sectional area after forging).

After the forging, cold work tool steel was subject to gradual cooling and, thereafter, the cold work tool steel was subject to spheroidizing.

Invention steels and comparison steels thus obtained were subjected to the following tests and evaluations.

<Area Rate of Carbide>

Cold work tool steel was cut to obtain a 15 mm square surface parallel to the forging direction (L direction). This surface was polished up to final diamond polishing and, thereafter, the surface was corroded with NITAL or BILELLA. A surface perpendicular to the forging direction (T direction) was also cut, polished and corroded in a similar manner. After the corrosion, it was observed with 100 magnifications of an optical microscope for ten fields of view, and the area rate of the carbide in each of the ten fields of view was measured. By setting the carbide having a circle equivalent diameter of 2 μm or more as a target, the area rate of the carbide was measured for each one field of view, and the average value of area rates in ten fields of view was obtained. This average value was set as the area rate of the carbide.

<Heat Treatment Condition>

Quenching and tempering were performed at temperatures shown in Table 2.

<Quantification of Retained Austenite Amount>

Specimens were cut out from the manufactured invention steels and comparison steels.

Quenching was performed such that the specimens were held at temperatures shown in Table 2 for 30 minutes and, thereafter, are cooled at an average cooling rate of 50° C./min. Thereafter, surfaces of the specimens were ground and polished, and surfaces of a thickness of 0.05 μm were removed by electrolytic polishing as final finishing. A retained austenite amount was obtained as an average rate from a ratio between a peak strength of martensite structure and a peak strength of the austenite structure using an X-ray diffraction apparatus.

Herein, a retained y amount shown in Table 2 indicates a volume rate (%) of the retained austenite amount in the steel after quenching and tempering.

<Size Change Rate Difference>

Specimens having a diameter of 10 μm and a length of 50 mm were cut out from the manufactured invention steels and the comparison steels and were then subject to working. Herein, with respect to the specimens which were sampled such that the longitudinal direction of the specimen became parallel to the forging direction and the specimens which were sampled in the direction perpendicular to the longitudinal direction of the specimen, length of these specimens were measured with respect to every 1 μm using a micrometer, and these lengths were set as reference values. Quenching and tempering were applied to these specimens at temperatures shown in Table 2. These heat treatments were carried out in a vacuum heat treatment furnace to prevent the specimens from being oxidized.

The lengths of the specimens were measured after quenching and after tempering, respectively, and change rates of lengths with respect to the reference values were obtained. Then, the difference between change rates of respective specimens in the direction parallel to the forging direction (L direction) and the direction perpendicular to the forging direction (T direction) (that is, size change rate in the L direction−size change rate in the T direction) was evaluated as the size change rate difference.

Figure 1B:
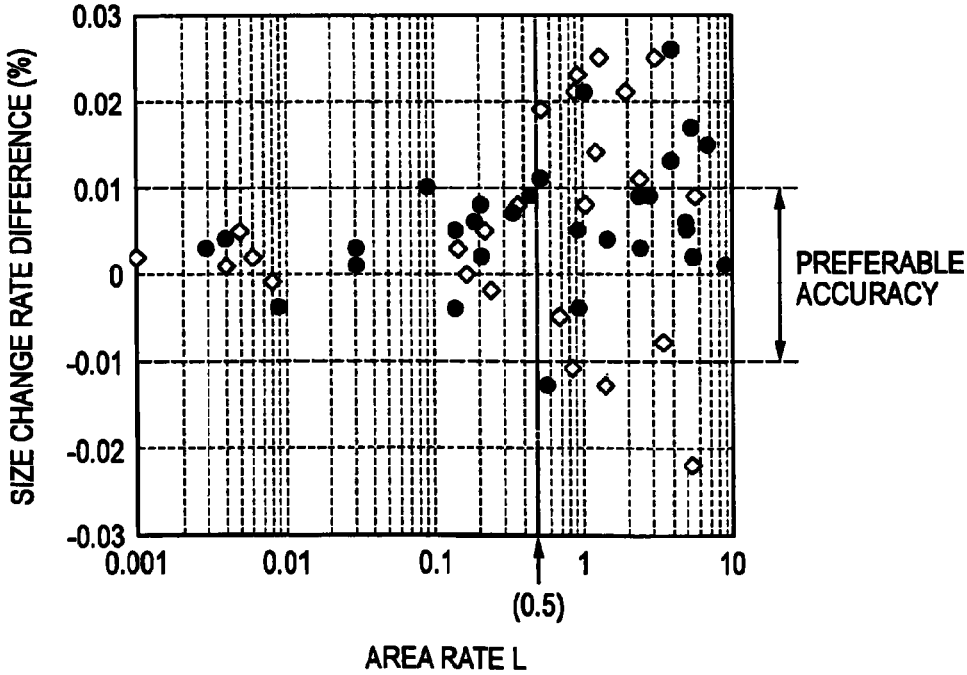
FIG. 1B is a view showing the relationship between an area rate L of a carbide in a cross section parallel to the forging direction and the size change rate difference.

The respective results are shown in Table 2 and FIGS. 1A and 1B.

In FIGS. 1A and 1B, results of similar tests on other samples are additionally shown in addition to the results shown in Table 2 (portion of the results shown in Table 2 being indicated by a matted circular mark and a matted triangular mark in the drawing).

TABLE 1

| | | C | Si | Mn | Cu | Ni | Cr | Mo | W | V | S | Al | O | N | Miscellaneous |
|---|---|---|---|---|---|---|---|---|---|---|---|---|---|---|---|
| Invention steel | 1 | 0.57 | 0.21 | 0.35 | 0.05 | 0.14 | 6.02 | 0.1 | 0.1 | 0.02 | | 0.33 | 0.0021 | 0.0145 | |
| | 2 | 0.84 | 0.64 | 0.51 | 0.11 | 0.15 | 6.35 | 0.34 | 0.01 | 0.02 | | 0.005 | 0.0014 | 0.0129 | |
| | 3 | 0.84 | 2.33 | 0.62 | 0.05 | 0.09 | 6.41 | 1.73 | | 0.38 | | 0.001 | 0.0019 | 0.0085 | |
| | 4 | 0.59 | 0.67 | 1.03 | 0.15 | 0.06 | 8.21 | 0.14 | | 0.39 | | 0.003 | 0.0024 | 0.0081 | |
| | 5 | 0.75 | 2.24 | 1.14 | 0.08 | 0.15 | 8.05 | 0.09 | 0.3 | 0.01 | | 0.005 | 0.0011 | 0.0071 | |
| | 6 | 0.78 | 2.34 | 1.09 | 0.03 | 0.15 | 8.14 | 0.1 | | 0.29 | | | | | |
| | 7 | 0.62 | 1.55 | 0.89 | 0.11 | 0.15 | 6.53 | 0.69 | | 0.06 | | | | | |
| | 8 | 0.63 | 1.73 | 1.14 | 0.02 | 0.08 | 7.83 | 0.94 | 0.22 | 0.09 | 0.09 | 0.042 | 0.0015 | 0.0156 | |
| | 9 | 0.7 | 1.86 | 1.2 | 0.06 | 0.31 | 7.43 | 0.99 | 0.5 | 0.11 | 0.08 | 0.055 | 0.0049 | 0.0185 | |
| | 10 | 0.66 | 1.73 | 1.18 | 0.04 | 0.15 | 7.91 | 1.03 | | 0.12 | 0.09 | 0.068 | 0.0048 | 0.0194 | Ca = 0.0056 |
| | 11 | 0.67 | 2.15 | 0.95 | 0.09 | 0.08 | 6.59 | 1.19 | | 0.07 | 0.05 | 0.011 | 0.0047 | 0.0031 | |
| | 12 | 0.63 | 2.19 | 0.84 | 0.05 | 0.15 | 6.83 | 1.34 | 0.04 | 0.16 | 0.07 | 0.009 | 0.0041 | 0.0018 | |
| | 13 | 0.7 | 0.92 | 0.89 | 0.09 | 0.16 | 6.97 | 0.24 | 0.8 | 0.13 | 0.06 | 0.023 | 0.0039 | 0.0144 | Nb = 0.09 |
| | 14 | 0.7 | 1.65 | 0.91 | 0.09 | 0.09 | 7.03 | 1.46 | | 0.11 | | 0.031 | 0.0038 | 0.0119 | |
| | 15 | 0.75 | 2 | 0.8 | 0.05 | 0.1 | 7.5 | 1.5 | | 0.05 | | | | | |
| | 16 | 0.67 | 2.14 | 0.78 | 0.15 | 0.1 | 7.93 | 0.55 | 0.9 | 0.18 | | 0.051 | 0.0028 | 0.0186 | Ti = 0.14 |
| | 17 | 0.68 | 2.18 | 0.82 | 0.05 | 0.22 | 7.76 | 1.79 | | 0.19 | 0.06 | 0.002 | 0.0025 | 0.0191 | |
| | 18 | 0.69 | 1.97 | 0.71 | 0.35 | 0.1 | 7.29 | 1.99 | | 0.14 | | 0.003 | 0.0031 | 0.0153 | Ta = 0.11 |
| | 19 | 0.64 | 2.04 | 0.78 | 0.1 | 0.1 | 6.92 | 0.48 | 0.3 | 0.14 | 0.09 | 0.004 | 0.0014 | 0.0141 | Zr = 0.10 |
| | 20 | 0.64 | 0.93 | 0.93 | 0.05 | 0.45 | 7.14 | 1.83 | | 0.16 | 0.08 | 0.001 | 0.0044 | 0.0099 | Ca = 0.0134 |
| | 21 | 0.69 | 0.95 | 0.95 | 0.01 | 0.3 | 7.41 | 1.45 | | 0.03 | 0.05 | 0.007 | 0.0014 | 0.0091 | Ca = 0.0063 |
| | 22 | 0.61 | 1.12 | 1.09 | 0.08 | 0.11 | 6.51 | 1.84 | | 0.04 | 0.07 | 0.009 | 0.0009 | 0.0169 | |
| | 23 | 0.61 | 1.3 | 0.93 | 0.07 | 0.08 | 7.36 | 1.61 | 0.02 | 0.09 | 0.07 | 0.003 | 0.0008 | 0.0145 | |
| | 24 | 0.79 | 2.41 | 1.05 | 0.13 | 0.32 | 8.32 | 1.14 | | 0.02 | | 0.013 | 0.0001 | 0.0131 | |
| | 25 | 0.83 | 0.24 | 0.93 | 0.07 | 0.31 | 8.56 | 1.2 | | 0.02 | 0.06 | 0.019 | 0.0004 | 0.0109 | Ca = 0.0014 |
| | 26 | 0.57 | 2.41 | 1.18 | 0.31 | 0.43 | 6.14 | 1.89 | | 0.21 | 0.08 | | | | Ca = 0.0035 |
| | 27 | 0.58 | 2.49 | 0.4 | 0.02 | 0.07 | 6.29 | 0.15 | | 0.24 | | | | | |
| | 28 | 0.58 | 2.28 | 0.44 | 0.08 | 0.04 | 8.67 | 1.03 | | 0.33 | | | | | |
| | 29 | 0.58 | 0.34 | 0.75 | 0.11 | 0.12 | 8.93 | 0.89 | | 0.34 | 0.04 | | | | Se = 0.04 |
| | 30 | 0.85 | 0.54 | 0.91 | 0.05 | 0.1 | 6.22 | 0.44 | | 0.01 | | | | | |
| Comparison steel | 1 | 0.75 | 2 | 0.8 | 0.05 | 0.1 | 7.5 | 1.5 | | 0.05 | | | | | |
| | 2 | 0.75 | 2 | 0.8 | 0.05 | 0.1 | 7.5 | 1.5 | | 0.05 | | | | | |
| | 3 | 1.4 | 0.3 | 0.4 | 0.05 | 0.1 | 12 | 1 | | 0.3 | | | | | |
| | 4 | 0.03 | 0.4 | 0.6 | 0.09 | 0.15 | 9.3 | 3.53 | | 0.15 | | | | | |
| | 5 | 0.53 | 0.5 | 0.84 | 0.15 | 0.23 | 19.3 | 1.95 | | 0.03 | | | | | |
| | 6 | 0.85 | 1.45 | 3.45 | 0.2 | 0.08 | 9.34 | 5.43 | | 0.06 | | | | | |

TABLE 2

| | | Heating temperature | Melting temperature | Forging ratio | Carbide area rate L | Carbide area rate T | L/T | Quenching temperature | Tempering temperature | Hardness | Retained γ Amount | Size change rate difference |
|---|---|---|---|---|---|---|---|---|---|---|---|---|
| Invention steel | 1 | 1240 | 1250 | 8.5 | 6.83 | 3.94 | 1.73 | 1160 | 540 | 65 | 14 | 0.025 |
| | 2 | 1200 | 1250 | 29.7 | 0.004 | 0.003 | 1.33 | 1020 | 450 | 57 | 6 | 0.004 |
| | 3 | 1160 | 1200 | 4.6 | 0.03 | 0.03 | 1.00 | 1030 | 580 | 63 | 16 | 0.001 |
| | 4 | 1160 | 1200 | 25.9 | 1.04 | 0.45 | 2.31 | 1040 | 500 | 61 | 21 | 0.021 |

TABLE 2-continued

| | | Heating temperature | Melting temperature | Forging ratio | Carbide area rate L | Carbide area rate T | L/T | Quenching temperature | Tempering temperature | Hardness | Retained γ Amount | Size change rate difference |
|---|---|---|---|---|---|---|---|---|---|---|---|---|
| | 5 | 1190 | 1200 | 9.5 | 0.45 | 0.16 | 2.81 | 1020 | 520 | 58 | 10 | 0.009 |
| | 6 | 1170 | 1180 | 24.2 | 0.003 | 0.001 | 3.00 | 1030 | 510 | 58 | 4 | 0.003 |
| | 7 | 1170 | 1180 | 0.98 | 0.09 | 0.03 | 3.00 | 1030 | 540 | 64 | 25 | 0.001 |
| | 8 | 1160 | 1210 | 1.1 | 0.94 | 1.03 | 0.91 | 1030 | 490 | 66 | 8 | −0.004 |
| | 9 | 1200 | 1230 | 11.6 | 0.43 | 0.31 | 1.39 | 1040 | 480 | 68 | 25 | 0.002 |
| | 10 | 1170 | 1190 | 6.9 | 0.93 | 0.65 | 1.43 | 1020 | 490 | 63 | 22 | 0.005 |
| | 11 | 1200 | 1220 | 4.3 | 0.03 | 0.023 | 1.30 | 1020 | 500 | 59 | 9 | 0.003 |
| | 12 | 1240 | 1260 | 8.4 | 0.07 | 0.06 | 1.17 | 1040 | 480 | 65 | 18 | 0.003 |
| | 13 | 1250 | 1260 | 19.4 | 0.49 | 0.22 | 2.23 | 1050 | 460 | 59 | 7 | 0.004 |
| | 14 | 1240 | 1260 | 9.1 | 0.44 | 0.34 | 1.29 | 1160 | 500 | 62 | 11 | 0.009 |
| | 15 | 1220 | 1230 | 20.3 | 0.09 | 0.08 | 1.13 | 1030 | 500 | 62 | 18 | 0.01 |
| | 16 | 1210 | 1230 | 1.04 | 0.48 | 0.41 | 1.17 | 1050 | 530 | 64 | 25 | 0.006 |
| | 17 | 1160 | 1180 | 6.9 | 0.31 | 0.34 | 0.91 | 1030 | 200 | 59 | 19 | 0.007 |
| | 18 | 1230 | 1250 | 14.5 | 0.14 | 0.11 | 1.27 | 1025 | 180 | 63 | 19 | 0.005 |
| | 19 | 1250 | 1280 | 3.4 | 0.19 | 0.14 | 1.36 | 1030 | 150 | 61 | 20 | 0.006 |
| | 20 | 1230 | 1250 | 18.3 | 0.21 | 0.14 | 1.50 | 1010 | 510 | 62 | 19 | 0.002 |
| | 21 | 1210 | 1250 | 6.3 | 0.21 | 0.08 | 2.63 | 1050 | 530 | 63 | 15 | 0.008 |
| | 22 | 1150 | 1200 | 17.9 | 0.09 | 0.07 | 1.29 | 1025 | 500 | 60 | 20 | 0.009 |
| | 23 | 1140 | 1180 | 5.9 | 0.15 | 0.11 | 1.36 | 1030 | 510 | 61 | 20 | 0.005 |
| | 24 | 1100 | 1150 | 5.9 | 0.009 | 0.008 | 1.13 | 1030 | 540 | 56 | 5 | −0.004 |
| | 25 | 1190 | 1200 | 19.5 | 0.14 | 0.15 | 0.93 | 1040 | 520 | 62 | 15 | −0.004 |
| | 26 | 1180 | 1200 | 4.6 | 0.34 | 0.12 | 2.83 | 1030 | 510 | 62 | 19 | 0.007 |
| | 27 | 1200 | 1220 | 3.3 | 0.53 | 0.31 | 1.71 | 1030 | 480 | 61 | 20 | 0.011 |
| | 28 | 1170 | 1220 | 10.3 | 3.94 | 1.44 | 2.74 | 1180 | 490 | 64 | 14 | 0.026 |
| | 29 | 1110 | 1150 | 1.9 | 0.58 | 0.61 | 0.95 | 1020 | 480 | 59 | 18 | −0.013 |
| | 30 | 1100 | 1150 | 8.3 | 3.85 | 3.11 | 1.24 | 1030 | 520 | 62 | 22 | 0.013 |
| Comparison steel | 1 | 1050 | 1230 | 19.3 | 10.33 | 3.32 | 3.11 | 1030 | 500 | 62 | 18 | 0.056 |
| | 2 | 1200 | 1230 | 1.55 | 5.33 | 0.91 | 5.86 | 1030 | 500 | 62 | 18 | 0.044 |
| | 3 | 1160 | 1180 | 56.3 | 4.93 | 1.45 | 3.40 | 1030 | 200 | 59 | 19 | 0.057 |
| | 4 | 1200 | 1220 | 9.3 | 0.0005 | 0.0005 | 1.00 | 880 | 200 | 38 | 3 | 0.003 |
| | 5 | 1150 | 1200 | 6.9 | 0.34 | 0.23 | 1.48 | 950 | 200 | 34 | 45 | 0.006 |
| | 6 | 1200 | 1230 | 3.6 | 3.56 | 1.56 | 2.28 | 1030 | 200 | 38 | 50 | 0.015 |

In FIG. 1A, the area rate ratio (L/T) is taken on an axis of abscissas and the size change rate difference is taken on an axis of ordinates. That is, FIG. 1A shows the relationship between the area rate ratio (L/T) and the size change rate difference.

Further, in FIG. 1B, the area rate L of carbide in the cross section parallel to the forging direction is taken on an abscissas and the size change rate difference is taken on an axis of ordinates. That is, FIG. 1B shows the relationship between the area rate L and the size change rate difference.

Although area rates L and T are respectively set to values of 0.5% or less in item 2 above, only the relationship between the area rate L and the size change rate difference is shown here. The relationship between the area rate T and the size change rate difference is completely similar to that between the area rate L and the size change rate difference.

First of all, from a result shown in FIG. 1A, it is understood that when the area rate ratio (L/T) falls within a range from 0.9 to 3.00, the required size change rate difference of −0.03 to 0.03 is satisfied.

Further, from a result shown in FIG. 1B, it is understood that by setting the area rate L of carbide in the cross section parallel to the forging direction to a value of 0.5% or less, the more desirable size change rate difference of −0.01 to 0.01 is satisfied.

As can be understood from the result shown in Table 2, the comparison steel 1 had the sane contents as the invention steel 15. However, since heating (soaking) was applied at the temperature lower than the temperature considered to be appropriate based on the melting temperature and, at the same time, the large forging ratio was given, a large amount of coarse carbides remained and the ratio L/T was outside the proper range. Accordingly, the size change rate difference was increased.

The comparison steel 2 had the same contents as the invention steel 15. However, since the comparison steel 2 was manufactured by lowering the cooling rate during casting, even when the proper heating temperature and forging ratio were given, the distribution of carbides cannot be controlled and hence, the ratio L/T was outside the proper range and the size change rate difference was increased.

With respect to the comparison steel 3, since the amounts of C and Cr were outside the proper ranges and the large forging ratio was given, the ratio L/T was outside the proper range and the size change rate difference was increased.

With respect to the comparison steels 4, 5 and 6, since the compositions of these steels were outside the proper range, their hardness are less than 40HRC and do not satisfy use hardness necessary for a tool steel. However, since the area rate ratios thereof were within proper range, the size change rate differences thereof were substantially equal to those of the invention steels.

To the contrary, all the invention steels exhibited favorable results.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2007-284326 filed on Oct. 31, 2007 and Japanese Patent Application No. 2008-206810 filed on Aug. 11, 2008, the contents thereof being incorporated herein by reference.

What is claimed is:

1. A tool steel comprising, by mass percent, 0.55 to 0.85% of C, 0.20 to 2.50% of Si, 0.30 to 1.20% of Mn, 0.50% or less of Cu,
0.01 to 0.50% of Ni,
6.00 to 9.00% of Cr,
0.1 to 2.00% of Mo+0.5W, and
0.01 to 0.40% of V,
with the balance of Fe and inevitable impurities,
wherein the tool steel is characterized by an area percentage of a coarse carbide having a circle equivalent diameter of 2 μm or more in a cross section parallel to a forging direction is represented by L(%) and an area percentage of the coarse carbide in a cross section perpendicular to the forging direction is represented by T(%), the area percentage L is 0.001% or more, the area percentage T is 0.001% or more, and the ratio L/T is within a range from 0.90 to 3.00.

2. The tool steel according to claim 1, wherein the area percentage L is 0.5% or less, and the area percentage T is 0.5% or less.

3. The tool steel according to claim 1, which further comprises, by mass percent, at least one element selected from the group consisting of:
0.040 to 0.100% of S,
0.040 to 0.100% of Se, and
0.040 to 0.100% of Te.

4. The tool steel according to claim 2, which further comprises, by mass percent, at least one element selected from the group consisting of:
0.040 to 0.100% of S,
0.040 to 0.100% of Se, and
0.040 to 0.100% of Te.

5. The tool steel according to claim 3, which further comprises, by mass percent, 0.0001 to 0.0150% of Ca.

6. The tool steel according to claim 4, which further comprises, by mass percent, 0.0001 to 0.0150% of Ca.

7. The tool steel according to claim 1, wherein contents of Al, O, and N are regulated to 0.50% or less, 0.0050% or less, and 0.0200% or less, respectively.

8. The tool steel according to claim 2, wherein contents of Al, O, and N are regulated to 0.50% or less, 0.0050% or less, and 0.0200% or less, respectively.

9. The tool steel according to claim 3, wherein contents of Al, O, and N are regulated to 0.50% or less, 0.0050% or less, and 0.0200% or less, respectively.

10. The tool steel according to claim 4, wherein contents of Al, O, and N are regulated to 0.50% or less, 0.0050% or less, and 0.0200% or less, respectively.

11. The tool steel according to claim 5, wherein contents of Al, O, and N are regulated to 0.50% or less, 0.0050% or less, and 0.0200% or less, respectively.

12. The tool steel according to claim 6, wherein contents of Al, O, and N are regulated to 0.50% or less, 0.0050% or less, and 0.0200% or less, respectively,

13. The tool steel according to claim 1, which further comprises, by mass percent, at least one element selected from the group consisting of:
0.01 to 0.15% of Nb,
0.01 to 0.15% of Ta,
0.01 to 0.15% of Ti, and
0.01 to 0.15% of Zr.

14. A method for manufacturing a tool steel according to claim 1, the method comprising:
casting steel with a control cooling at a cooling rate from start to completion of solidification within a range of 0.1 to 5.0° C/min to produce a steel casting;
performing a soaking treatment by heating the steel casting at least once at a temperature within the range of 1100° C. to 1250° C. or within a range of −50° C. to −10° C. from a melting point of the tool steel, for 10 hours or more to produce a heat-treated steel; and
hot forging heat-treated steel at a temperature within a range of 950° C. to 1250° C. such that a forging ratio is within a range from 0.85 to 30.

* * * * *